US006314666B1

(12) United States Patent
Klemenhagen et al.

(10) Patent No.: US 6,314,666 B1
(45) Date of Patent: Nov. 13, 2001

(54) MATERIAL MOVING BLADE

(75) Inventors: David D. Klemenhagen, North Mankato; Roger J. Scheurer, Kasota; Vincent J. Tomlonovic, North Mankato, all of MN (US)

(73) Assignee: Hiniker Company, Mankato, MN (US)

( * ) Notice: Subject to any disclaimer, the term of this patent is extended or adjusted under 35 U.S.C. 154(b) by 0 days.

(21) Appl. No.: 09/718,287

(22) Filed: Nov. 22, 2000

Related U.S. Application Data

(60) Provisional application No. 60/196,251, filed on Apr. 11, 2000.

(51) Int. Cl.[7] ..... E01H 5/06

(52) U.S. Cl. ..... 37/267; 172/815; 37/195

(58) Field of Search ..... 37/267, 266, 214, 37/219, 231, 232, 234, 233, 449, 903, 195; 172/811, 815, 816

(56) References Cited

PUBLICATIONS

FFC Snow Push—2 pgs. from Brochure, Date Unknown.
The Snowman Snowplow Brochure, Date Unknown.

*Primary Examiner*—Christopher J. Novosad
(74) *Attorney, Agent, or Firm*—Reising, Ethington, Barnes, Kisselle, Learman & McCulloch, P.C.

(57) ABSTRACT

The material moving blade has a moldboard assembly with a lower moldboard portion and an upper moldboard portion. A hinge connects the upper moldboard portion to the lower moldboard portion for pivotal movement about a horizontal axis. An upper cutting bar with an upper bar working edge is clamped to a top edge of the upper moldboard portion. A lower cutting bar with a lower bar working edge is clamped to a bottom edge of the lower moldboard portion. An actuator pivots the upper moldboard portion about the horizontal axis in one direction to a position in which the upper cutting bar is above the lower moldboard portion and in another direction to a position in which the upper bar working edge is below the lower bar working edge and the upper moldboard material contact surface faces rearward.

10 Claims, 7 Drawing Sheets

MATERIAL MOVING BLADE

The material moving blade for moving material such as soil, gravel or snow has a hinged moldboard which permits the blade to be configured to move material forward and backwards. The disclosure incorporates a material moving blade disclosed in provisional patent application 60/196,251, filed Apr. 11, 2000, whose priority is claimed for this application.

BACKGROUND OF THE INVENTION

Blades are attached to machines to push various materials from one place to another. These machines can be tractors with tracks, wheeled tractors, skid steer loaders, trucks and other powered vehicles. Materials are generally moved relatively short distances by blades that push. If material is to be moved a substantial distance, it is normally loaded in a vehicle.

Materials that are pushed short distances are generally moved in one direction to a common area. To move material in one direction, the vehicle returns to a starting position with the blade raised. Occasionally material can be moved in two directions to two separate areas. When moving material to two separate areas, the vehicle can be turned around at each end of a pass. However, turning the vehicle around may take more time than returning with the blade raised.

A blade which can move material in two directions could, in some situations, come close to doubling the material moved per hour. Unfortunately the blades that are currently used to push material are not able to move material efficiently when moving backwards. Their blades generally tend to ride up over material when moving to the rear and move less material than they move when moving forward.

There are situations in which blades need to move material on their backsides because the vehicle cannot be turned around to push material. One example of such a need is moving soil from a building wall or foundation. Other examples include moving snow away from garage doors and entry doors.

SUMMARY OF THE INVENTION

The material moving blade includes a moldboard, a lower cutting edge or scraper blade and an upper cutting edge or scraper blade. The moldboard carries a support frame attachment structure for connecting the blade to the support frame mounted on a vehicle. The moldboard includes a lower moldboard section and an upper moldboard section. The lower moldboard section carries the support frame attachment structure. The upper moldboard section is pivotally attached to the lower moldboard section for pivotal movement about a generally horizontal axis. At least one actuator is carried by the moldboard for pivoting the upper moldboard section relative to the lower moldboard section between a forward material pushing position and a back dragging position.

The lower cutting edge tends to force the blade downward when pushing material forward relative to the tractor or other vehicle. The upper blade tends to force the blade downward when moving the vehicle backwards. This ability to move material in two directions can, in some situations, double the quantity of material moved during a fixed period of time. The ability to back drag material also eliminates the need to move some material manually away from buildings, doors, fences and other structures.

BRIEF DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 1:
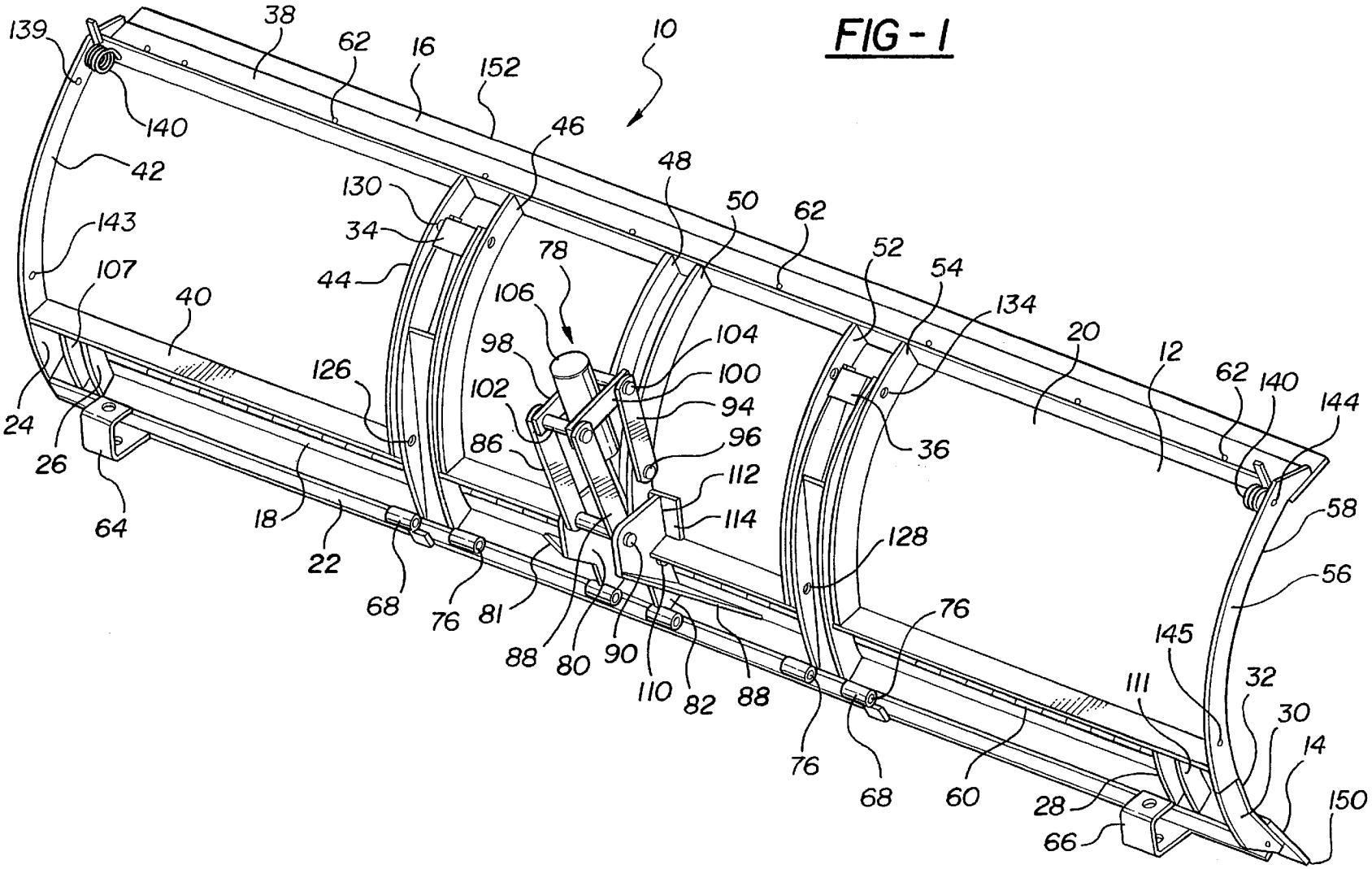
FIG. 1 is a perspective view showing the rear side of the material moving blade in an extended vertical position.

The material moving blade 10 has a moldboard assembly 12 with a lower cutting bar 14 and an upper cutting bar 16. The moldboard assembly 12 includes a lower moldboard portion 18 and an upper moldboard portion 20. The lower moldboard portion 18 has a lower horizontal beam 22, a plurality of vertical bars 24, 26, 28 and 30 attached to the lower horizontal beam 22 and an elongated lower moldboard plate 32 that is attached to the forward side of the lower horizontal beam 22 and to the plurality of vertical bars 24, 26, 28 and 30. The lower moldboard plate 32 is a generally arcuate member. Two vertical spaced apart upper moldboard supports 34 and 36 are welded to the lower horizontal beam 22.

The upper moldboard portion 20 of the moldboard assembly 12 has an upper horizontal beam 38, a lower bar 40 that is parallel to the upper horizontal beam and a plurality of vertical bars 42–56 that are welded to the upper horizontal beam 38 and the lower bar 40. An elongated upper moldboard plate 58 is secured to a forward side of the upper horizontal beam 38, the lower bar 40 and the vertical bars 42–56. As shown in the drawing figures, the upper moldboard plate 58 is an arcuate member that is an arc about a horizontal axis.

A hinge 60 pivotally connects the upper moldboard 20 to the lower moldboard 18 for pivotal movement about a horizontal axis. The lower cutting bar 14 is clamped to the lower moldboard plate 32 by bolts 62. The upper cutting bar 16 is clamped to the upper horizontal beam 38 by bolts 62 shown in FIG. 1. The upper and lower cutting bars 14 and 16 scrape the surfaces that the material being moved is supported by. As a result, the upper and lower cutting bars 14 and 16 may be subjected to substantial wear even though they are made from a hardened steel. The bolts 62 facilitate removal and replacement of worn bars 14 and 16.

Skid mounting brackets 64 and 66 are secured to the ends of the lower horizontal beam 22. Skid members (not shown) are secured to the mounting brackets 64 and 66 in some cases to limit downward movement of the material moving blade 10. These skids are frequently employed when pushing snow on a paved surface.

Attachment members 68 are secured to the lower horizontal beam 22. A tubular member 70 of a support frame assembly 72 is pivotally attached to the attachment members 68 by pins 74 received in the bores 76 in the attachment member 68.

A moldboard pivot actuator assembly 78 is provided to pivot the upper moldboard portion 20, about the axis of the hinge 60, relative to the lower moldboard portion 18. The pivot actuator assembly 78 includes two spaced apart mounting plates 80 and 82 that are welded to the lower horizontal beam 22 and reinforced by gussets 81 and 83. A pair of parallel links 86 and 88 are pivotally attached to the mounting plates 80 and 82 by a horizontal pin 90. A pair of parallel links 92 and 94 are pivotally attached to the vertical bars 48 and 50, of the upper moldboard portion 20, by a horizontal pin 96. Connector links 98 and 100 are pivotally connected to the links 86 and 88 by a pin 102. Another pin 104 pivotally connects the links 98 and 100 to the links 92 and 94. A hydraulic cylinder 106 is rigidly connected to the links 98 and 100. A rod 108 of the hydraulic cylinder 106 is pivotally attached to the lower moldboard portion 18 by a pivot pin 110 that passes through the mounting plates 80 and 82. Extension of the hydraulic cylinder 106 pivots the upper moldboard 20 about the axis of the hinge 60 to the forward material pushing position shown in FIG. 3. In the forward material pushing position, stop surfaces 112 on the mounting plates 80 and 82 contact reinforcing plates 114 on the upper moldboard portion 20 and prevent further extension of the hydraulic cylinder 106. Vertical bars 26 and 28 on the lower moldboard portion 18 contact the lower bar 40 on the upper moldboard portion when the blade 10 is in the forward material pushing position. Vertical bars 107 and 111 on the upper moldboard portion 20 contact the lower horizontal beam 22 on the lower moldboard portion 18 when the blade 10 is in the forward material pushing position. The vertical bars 26, 28, 107 and 111 cooperate with the stop surfaces 112 to limit extension of the hydraulic cylinder 106.

Figure 4:
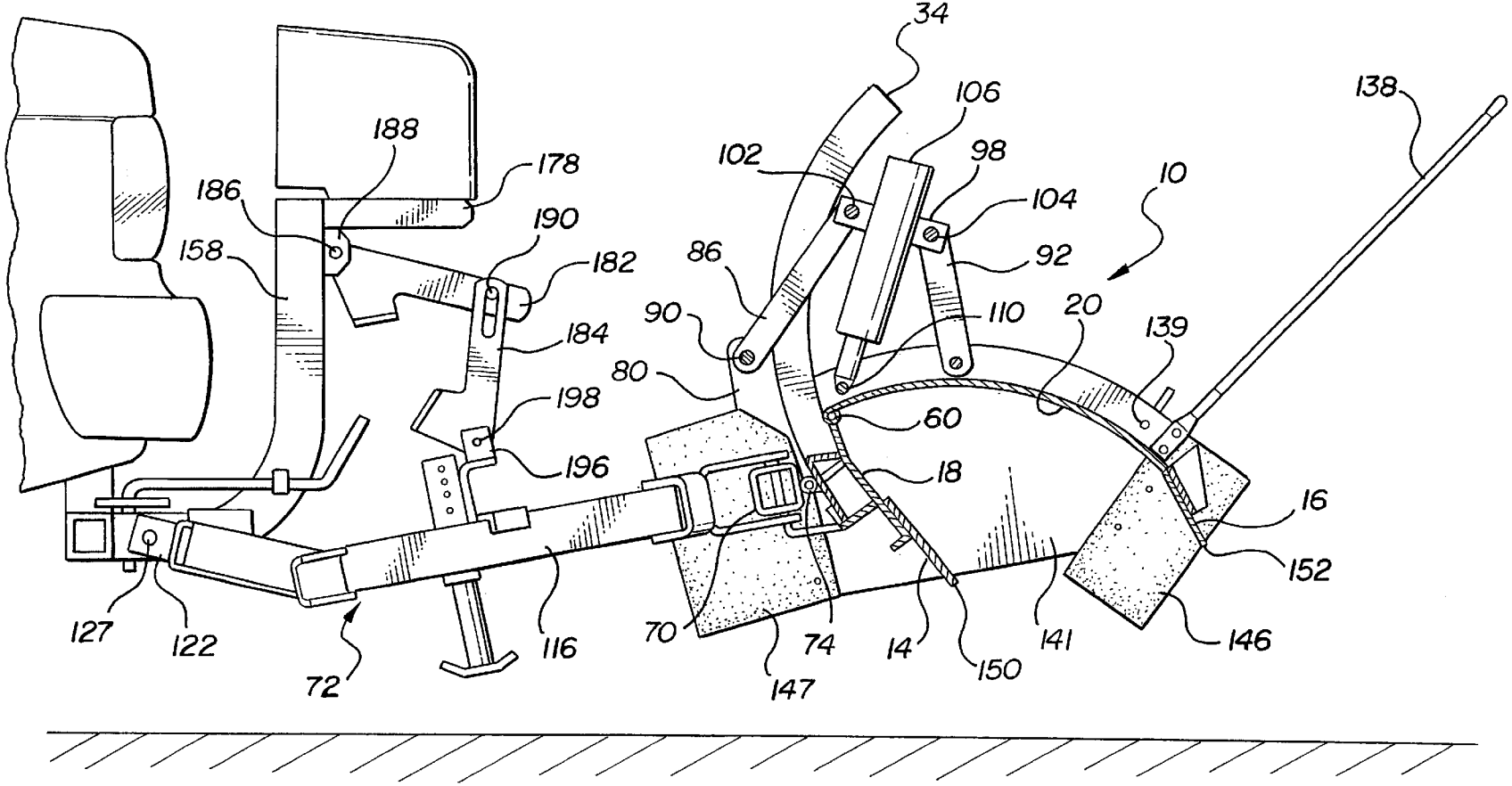
FIG. 4 is a side elevational view of the blade support frame with parts broken away, the material moving blade in a partially folded position and with the lift cylinder removed.
Figure 5:
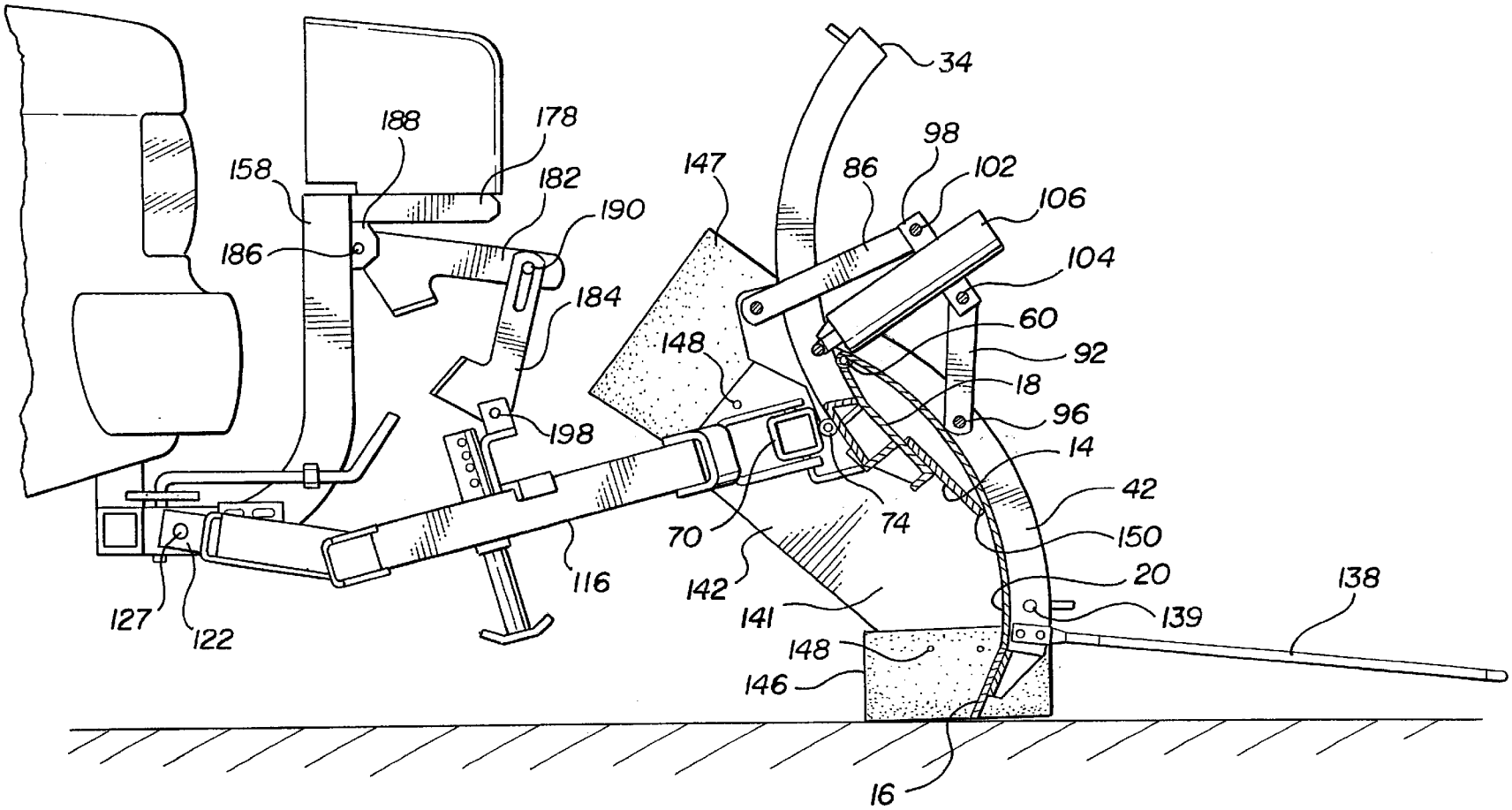
FIG. 5 is a side elevational view of the blade support frame and the material moving blade in a fully folded position for pulling material in a rearward direction and with the lift cylinder removed.
Figure 6:
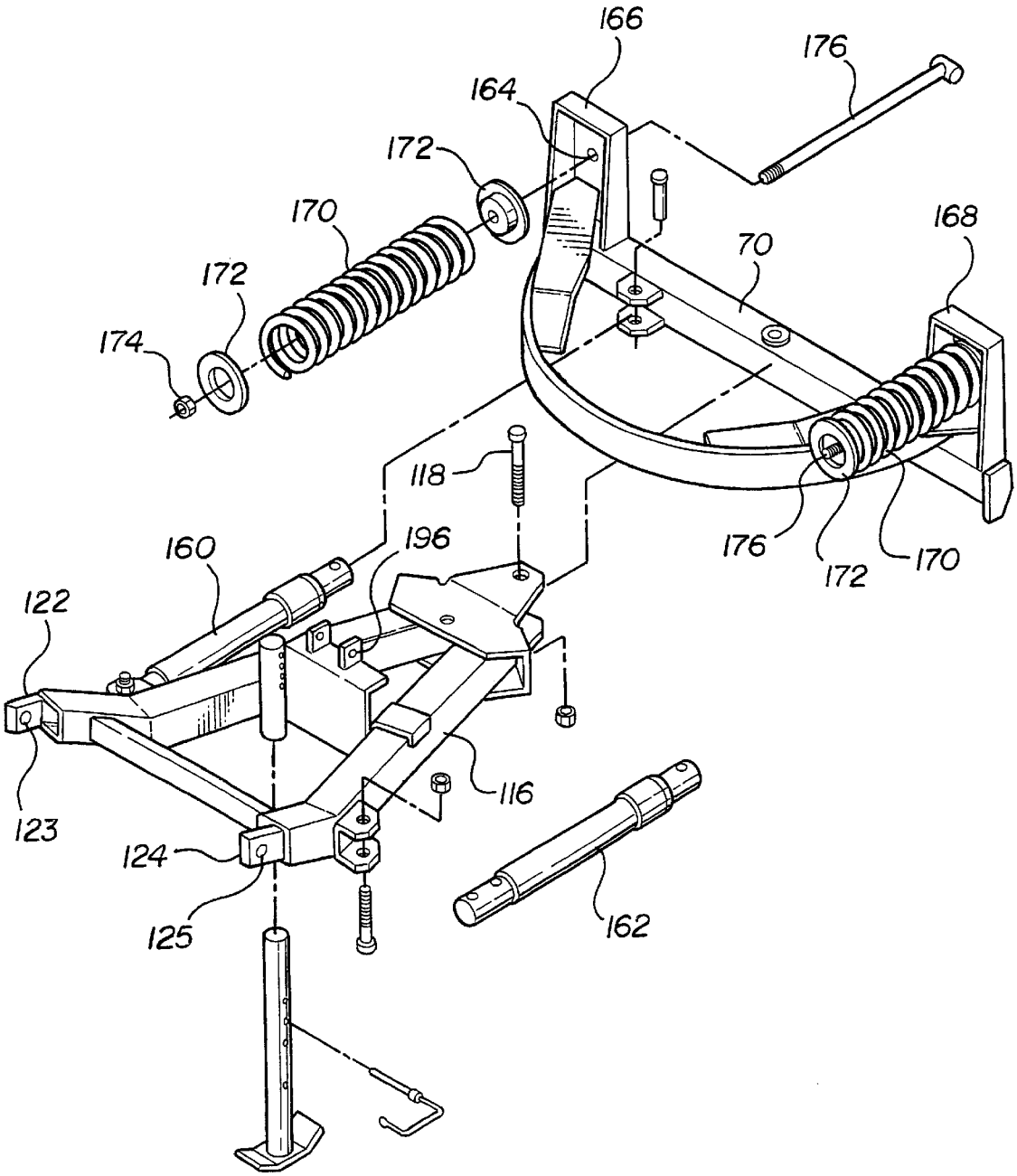
FIG. 6 is an expanded perspective view of the A-frame and the spring cushion assembly.

Retraction of the hydraulic cylinder 106 pivots the upper moldboard portion 20 clockwise or forward as shown in FIGS. 4 and 5 about the axis of the hinge 60 to the back drag position shown in FIG. 5. A number of different moldboard pivot actuators could be used in place of the pivot actuator 78 shown in the drawings.

Figure 3:
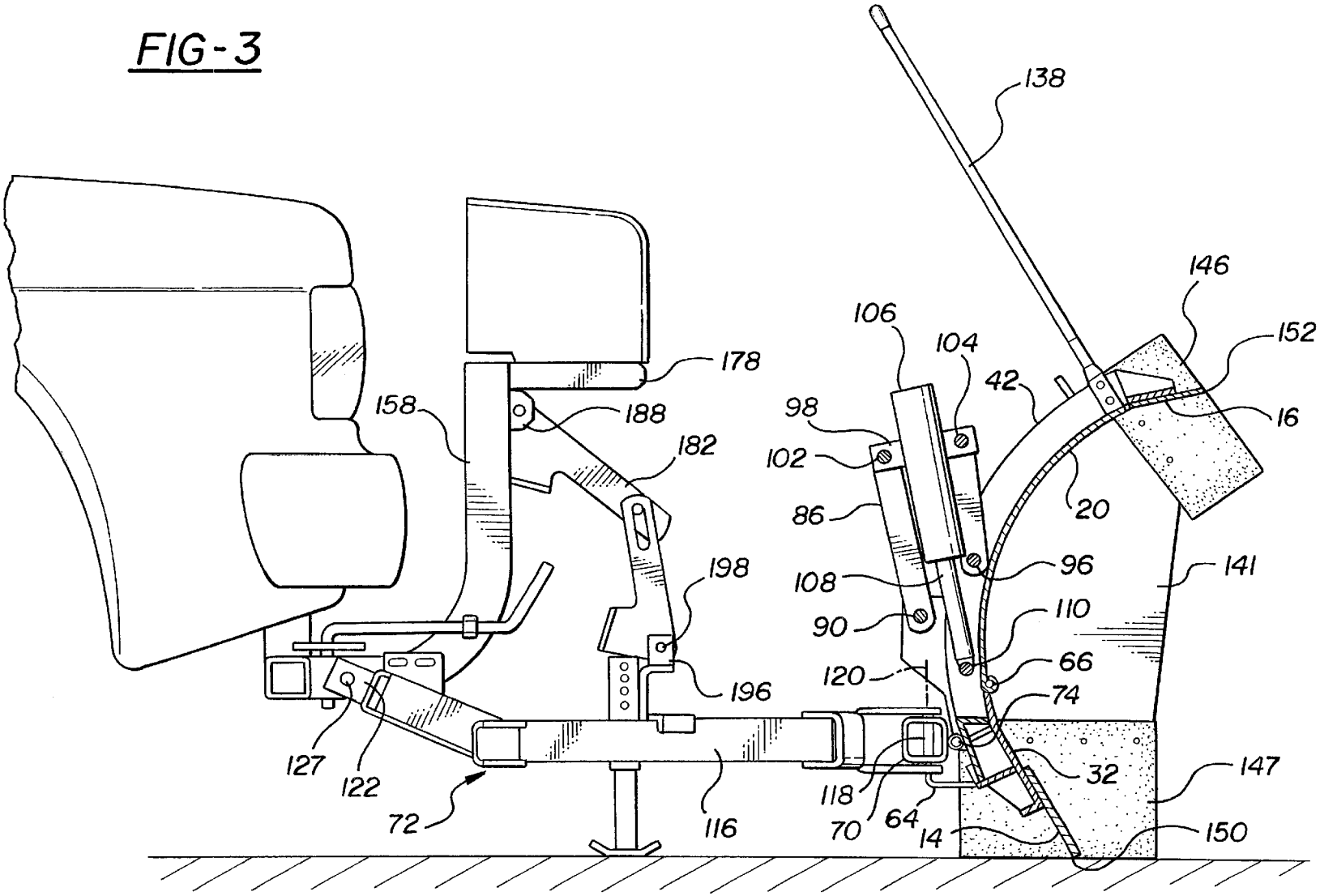
FIG. 3 is a side elevational view of the blade support frame, the material moving blade in an unfolded position for pushing material forward and with the lift cylinder removed.

The hydraulic cylinder 106 can be retracted as shown in FIGS. 4 and 5 to pivot the upper moldboard portion 20 clockwise about the axis of the hinge 60 a short distance from the position shown in FIG. 3. By pivoting the upper moldboard portion 20 a few degrees about the axis of the hinge 60, it is often possible to reduce or even eliminate the loss of material that spills over the top of the upper moldboard portion 20 in some conditions. This adjustment can be a significant help when moving lightweight material such as snow.

The tubular member 70 of the support frame assembly 72 is pivotally attached to an A-frame 116 by a pivot pin 118 with a generally vertical axis 120. The A frame 116 has two spaced apart legs 122 and 124 with bores 123 and 125 that receive pins 127 and 129 which pivotally attach the A frame to ears 131 and 133 on a lift frame 158. Linear actuators 160 and 162 pivot the horizontal beam 70 about the vertical axis 120 shown in FIG. 3 to a selected position. A pin 176 is pivotally anchored in the aperture 126 in the upper moldboard support 34 and passes through the bore 164 through the upright 166. Another pin 176 is pivotally anchored in the aperture 128 and passes through a bore through the upright 168. A compression spring 170 with end washers 172 is mounted on each pin 176 and preloaded by a nut 174. The springs 170 permit the blade 10 to pivot about the axis of the pins 74 when the lower cutting bar 14 strikes an obstruction.

Figure 7:
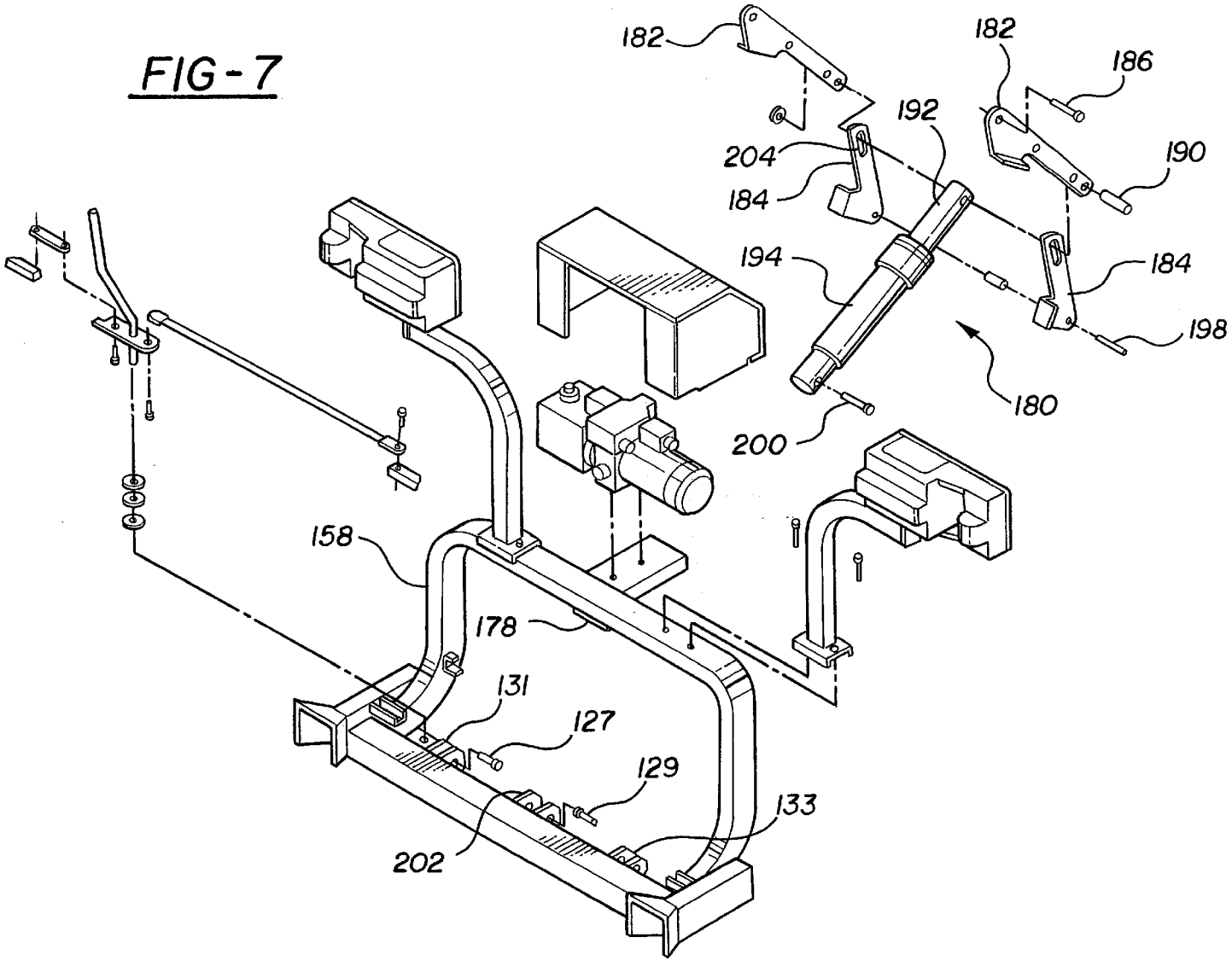
FIG. 7 is an expanded perspective view of the mast and lift assembly.

The support frame 72 shown in FIGS. 3, 4 and 5 is used for attaching a snowplow to the front of a light or medium duty truck. The support frame 72 is used in combination with a mast portion 178 of the lift frame 158 and lift assembly 180 that raises the material moving blade 10 as required. The lift assembly 180 includes two pairs of parallel scissor linkages. Each scissor linkage has an upper link 182 and a lower link 184. A pin 186 connects the upper ends of both upper links 184 to tabs 188 of the mast portion 178. A pin 190 pivotally connects the upper links 182 to the lower links 184 and to the piston rod 192 of a hydraulic cylinder 194 shown in FIG. 7. The lower ends of the lower links 184 are pivotally attached to a pair of ears 196 on the A-frame 116 by a pin 198. A pin 200 pivotally connects the hydraulic cylinder 194 between ears 202 on the lift frame 158. The slots 204 in the lower links 184 permit the moldboard assembly 12 to ride up over hard surfaces and obstructions. This arrangement does not normally transfer weight from the vehicle to the material moving blade 10.

The material moving blade 10 can be attached to different support frame assemblies for use on track type tractors, wheeled tractors and other vehicles. Some of these vehicles can transfer weight from the vehicle to the moldboard assembly 12.

The material moving blade 10 can be changed in size, weight and strength as required while retaining the moldboard assembly 12 with a horizontal hinge 60 and the ability to push material in two directions as described above.

There may be a desire to use the material moving blade 10 as a fixed standard blade without the moldboard pivotal actuator 78. Apertures 130 through vertical bars 44 and 46 and the bore 132 through the upper moldboard support 34 can receive a first locking pin (not shown). A second locking pin (not shown) can be inserted through apertures 134 through the vertical bars 52 and 54 and the bore 136 through the upper moldboard support 36. These first and second locking pins prevent pivotal movement of the upper moldboard portion 20 relative to the lower moldboard portion 18.

A pair of flexible locating rods 138 may be attached to the ends of the upper horizontal beam 38. These rods 138 are generally some bright color. Their purpose is to indicate, to the operator of a vehicle, that carries the material moving blade 10, the position of the ends of the blade and assist in avoiding obstructions. The rods 138 can be rigidly secured to the vertical bars 42 and 56 and the upper horizontal beam 38 by bolts or they can be pivotally attached. If the rods 138 are pivotally attached, coil springs 140 bias the rods toward an upstanding position.

Figure 2:
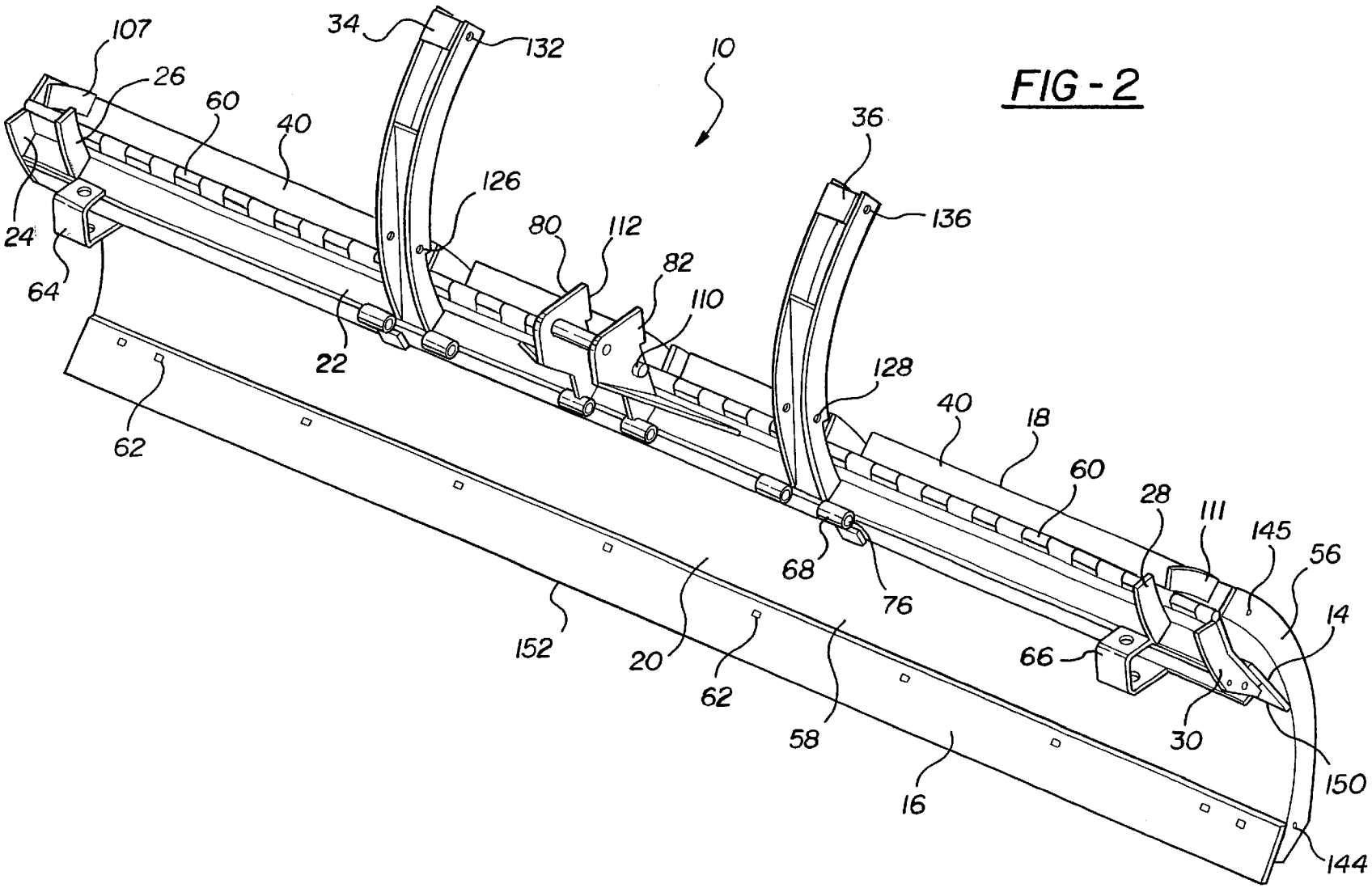
FIG. 2 is a perspective view of the material moving blade in a folded position for back dragging material.

Optional end plate assemblies 142 are attached to the ends of the upper moldboard portion 20 to keep material from dribbling off the ends of the material moving blade 10 when back dragging material. End plate assemblies 142 also limit material dribbling when pushing material in a forward direction. Each end plate assembly 142 includes a steel end plate 141. One steel end plate 141 is attached to the vertical bar 42 by two pins that pass through bores 139 and 143. The other end plate 141 is attached to the vertical bar 56 by two pins that pass through bores 144 and 145. Both end plate assemblies 142 have upper plate extensions 146 and lower plate extensions 147. These plate extensions 146 and 147 are flexible members made from rubber conveyor belting with reinforcing cords or similar material. Mechanical fasteners 148 secure the plate extensions 146 and 147 to the end plates 141. Since the end plate assemblies 142 are attached to the upper moldboard portion 20 only, they move relative to the lower moldboard portion 18 when the upper moldboard is pivoted by the moldboard pivot actuator assembly 78. The end plate assemblies 142 are only usable when the material moving blade 10 is in the extended vertical position shown in FIG. 1 or in the folded position for back dragging material shown in FIG. 2. The end plate assemblies 142 are usable when the material moving blade 10 is in a partially folded position as shown in FIG. 4 if the plate extensions 146 are removed or modified. The portion of the upper plate extension 146 that extends downward below the level of the working edges 150 and 152 can be removed. The use of end plate assemblies 142 in the position shown in FIG. 4, with portions of the extension 146 removed as explained above, would most likely not interfere with operation of the working edge 150.

The material moving blade 10 as shown in FIG. 3 is in a position for pushing material forward and to the right. In this position the lower cutting bar 14 scrapes material up. The upward and rearward slope of the cutting bar 14 causes the material that is being moved to exert a downward force on the material moving blade 10. The moldboard assembly 12 is curved in an arc about a horizontal axis that is forward of the blade 10. Movement of the material moving blade 10 to the rear or left as shown in FIG. 3 will move a little material before the lower cutting edge 14 slides up over some material.

The material moving blade 10 as shown in FIG. 4 has an upper moldboard portion 20 pivoted to a position in which the lower cutting bar 14 and the upper cutting bar 16 are at the same height. Material can be moved with the blade 10 in this partially folded position. The simultaneous use of both cutting bars 14 and 16, as shown in FIG. 4, when moving to the rear would be useful for final leveling of soil prior to planting grass for example.

The material moving blade 10, as shown in FIG. 5, is in a position for back dragging material to the left. The upper cutting bar 16 is in a material moving position. The lower cutting bar 14 is lifted a substantial distance above the upper share 16. The upper cutting bar 16 and upper moldboard portion 20 can pull a substantial quantity of material before material moves up over the highest portion of the blade 10. The forward portion of the support frame assembly 72 is raised substantially from the position shown in FIGS. 3 and 4 to create more volume for pulling material.

The material moving blade 10 has an upper moldboard portion 20 with a distance, in a vertical plane parallel to the direction of travel, from the axis of hinge 60 to the working edge 152 of the upper cutting edge 16 that is more than twice the distance from the axis of the hinge 60 to the working edge 150 of the lower cutting edge 14. The distance from the working edge 152 to the axis of the hinge 60 must exceed the distance from the axis of the hinge to the working edge 150 for the working edge 152 to move material. How much the distance from the working edge 152 to the axis of the hinge 60 exceeds the distance from the axis of the hinge 60 to the working edge 150 is a matter of choice. The axis of the hinge 60, as shown in the drawing, is adjacent to the lower bar 40 of the upper moldboard portion 18. The hinge 60 can be designed to position the pivot axis of the pivot pin 110 in a location spaced from the lower bar 40. The pivot pin axis must however be closer to the working edge 150 than to the working edge 152. The geometry shown in the drawings and explained above works well.

The support frame assembly 72 described above and shown in the drawings is for snowplows. The moldboard assembly 12 is not restricted to use with such a support frame assembly 72 as stated above. The moldboard assembly 12 could for example be mounted on a support frame for a dozer blade. When the moldboard assembly 12 is used in place of a dozer blade, it may be fixed about a vertical axis. The moldboard assembly 12 can also be adjustable about a vertical axis. The lower moldboard portion 18 can be fixed or adjustable about a horizontal axis relative to the vehicle upon which the moldboard assembly 12 is mounted.

During some material moving operations it is desirable to tilt a moldboard assembly about a generally horizontal axis that is parallel to the direction of movement of a vehicle upon which the moldboard assembly 12 is mounted. Such movement will lower one end of each of the cutting bars 14 and 16 and raise the other end of each of the cutting bars. The moldboard assembly 12, described above, can be mounted on a support frame that is capable of tilt adjustments.

The construction of the moldboard assembly 12 can be changed as required to accommodate the materials that are to be moved without departing from the invention described above. The moldboard assembly 12 can be strengthened to move high density materials. The moldboard assembly 12 can also be reduced in weight to move low density materials. Various sizes of moldboard assemblies 12 can also be made to accommodate large high powered vehicles or small low powered vehicles.

The disclosed embodiment is representative of a presently preferred form of the invention but is intended to be illustrative rather than definitive thereof. The invention is defined in the claims.

We claim:

1. A material moving blade adapted to be mounted on a vehicle to push material forward and to back drag material comprising:

a moldboard assembly having a lower moldboard portion and an upper moldboard portion;

a lower bar, on the lower moldboard portion, forming a bottom edge of the lower moldboard portion;

an upper bar, on the upper moldboard portion, forming a top edge of the upper moldboard portion;

a hinge assembly pivotally attaching the upper moldboard portion to the lower moldboard portion for pivotal movement about a horizontal axis between a forward material pushing position in which the upper bar is above the bottom edge on the lower moldboard portion and a back dragging position in which the top edge on the upper bar is below the bottom edge;

an attachment structure on the lower moldboard portion for attaching the moldboard assembly to a plow support; and an actuator attached to the lower moldboard portion and the upper moldboard portion for pivoting the upper moldboard portion about the horizontal axis.

2. A material moving blade as set forth in claim 1 wherein the lower moldboard portion includes an upper moldboard support that limits pivotal movement of the upper moldboard portion relative to the lower moldboard portion about the horizontal axis in one direction.

3. A material moving blade as set forth in claim 1 wherein the lower bar is clamped to the lower moldboard portion by mechanical fasteners.

4. A material moving blade as set forth in claim 1 wherein the upper bar is clamped to the upper moldboard portion by mechanical fasteners.

5. A material moving blade as set forth in claim 1 wherein the actuator includes a hydraulic cylinder attached to the lower moldboard portion and a linkage connected to the hydraulic cylinder and to the upper moldboard portion.

6. A material moving blade as set forth in claim 1 wherein the actuator includes a first link pivotally connected to the upper moldboard portion, a second link pivotally connected to the lower moldboard portion, a connector link pivotally connected to the first link and to the second link, and a linear actuator pivotally connected to the lower moldboard portion and fixed to the connector link.

7. A material moving blade as set forth in claim 1 including a first end plate secured to a first end of the upper moldboard portion, a second end plate secured to a second end of the upper moldboard portion and wherein the first end plate and the second end plate are pivotal with the upper moldboard portion relative to the lower moldboard portion.

8. A material moving blade adapted to be mounted on a vehicle to push material forward and to back drag material comprising:

a moldboard assembly having a lower moldboard portion and an upper moldboard portion;

a lower cutting bar with a lower bar working edge clamped to the lower moldboard portion adjacent to a bottom edge of the lower moldboard portion;

an upper cutting bar with an upper bar working edge clamped to the upper moldboard portion adjacent to a top edge of the upper moldboard portion;

a hinge assembly fixed to an upper moldboard lower edge and fixed to a lower moldboard upper edge and having a horizontal hinge axis that is adjacent to the upper moldboard lower edge and to the lower moldboard upper edge;

an upper moldboard support fixed to the lower moldboard portion and having a support free end that is spaced from the horizontal hinge axis and contacts the upper moldboard portion to limit pivotal movement of the upper moldboard portion about the horizontal hinge axis in one direction;

an actuator assembly including a first link pivotally connected to the upper moldboard portion, a second link pivotally connected to the lower moldboard portion, a connector link pivotally connected to the first link and to the second link, and a linear actuator pivotally connected to the lower moldboard portion and fixed to the connector link and wherein extension of the linear actuator pivots the upper moldboard portion into a forward material pushing position and into contact with the support free end of the upper moldboard support and wherein retraction of the linear actuator pivots the upper moldboard portion into a back dragging position in which the upper bar working edge on the upper cutting bar is below the lower cutting bar; and an attachment assembly on the lower moldboard portion for attaching the moldboard assembly to a plow support.

9. A material moving blade as set forth in claim 8 including a first end plate secured to a first end of the upper moldboard portion, a second end plate secured to a second end of the upper moldboard portion and wherein the first end plate and the second end plate are pivotal with the upper moldboard portion relative to the lower moldboard portion.

10. A method of conveying material with a material moving blade having a moldboard assembly with a lower moldboard portion and upper moldboard portion pivotally attached to the lower moldboard portion for pivotal movement about a horizontal axis and having a lower cutting bar on a bottom edge of the lower moldboard portion and an upper cutting bar on a top edge of the upper moldboard portion comprising:

pivoting the upper moldboard portion about the horizontal axis to a position in which the upper cutting bar is above the lower moldboard portion;

moving the material moving blade forward to scrape up material and move material forward;

pivoting the upper moldboard portion about the horizontal axis to move the upper bar working edge of the upper cutting bar to a position below the lower cutting bar and to move a material contacting surface of the upper moldboard portion from a forward facing position to a rearward facing position; and moving the material moving blade to the rear to scrape up material with the upper cutting bar and convey material to the rear.

* * * * *